United States Patent [19]

Horne

[11] Patent Number: 4,498,557

[45] Date of Patent: Feb. 12, 1985

[54] EMERGENCY ESCAPE APPARATUS AND METHOD OF USING SAME

[76] Inventor: June B. Horne, 1713 W. 90th St., Chicago, Ill. 60620

[21] Appl. No.: 506,106

[22] Filed: Jun. 20, 1983

[51] Int. Cl.[3] ..... A62B 1/20

[52] U.S. Cl. ..... 182/49; 193/12

[58] Field of Search ..... 182/49, 48; 193/2 A, 193/12

[56] References Cited

U.S. PATENT DOCUMENTS

| | | | |
|---|---|---|---|
| 715,560 | 12/1902 | Dedrick | 182/48 |
| 740,917 | 10/1903 | Prouty | 182/48 |
| 814,855 | 3/1906 | Logan | 193/12 |
| 1,149,689 | 8/1915 | Rosner | 182/49 |
| 2,270,909 | 1/1942 | Spizer | 182/49 |
| 3,016,975 | 1/1962 | Gogol et al. | 182/48 |
| 3,063,513 | 11/1962 | Marryatt | 182/49 |
| 3,743,281 | 7/1973 | Gimbel | 182/49 |
| 3,796,429 | 3/1974 | Johnston | 182/49 |
| 4,109,759 | 8/1978 | Cundiff, Jr. | 182/19 |
| 4,109,760 | 8/1978 | Marra | 182/48 |

*Primary Examiner*—Reinaldo P. Machado
*Attorney, Agent, or Firm*—Bernard L. Kleinke

[57] ABSTRACT

The emergency escape apparatus includes a slide device installed at a staircase, and includes a slide member extending at an incline over the stairs when disposed in its use position. In order to use the apparatus, the slide member swings about a hinge device connected at one side edge of the slide member between an upward storage position adjacent to the railing or the like and the incline use position over the stairs. Mounting devices fix the slide member to the staircase, and a latching device maintains the slide member in its upright storage position in a releasable manner.

7 Claims, 5 Drawing Figures

EMERGENCY ESCAPE APPARATUS AND METHOD OF USING SAME

DESCRIPTION

Technical Field

The present invention relates in general to an emergency escape apparatus and a method of using it. The invention more particularly relates to an emergency escape apparatus which is adapted to be used to help evacuate large buildings, such as hospitals and the like.

Background Art

There have been many different types and kinds of emergency fire escape equipment used on multi-storied buildings and the like, as well as other types of equipment which may be used for moving persons quickly from a building structure. For example, reference may be made to the following U.S. Pat. Nos. 715,560; 740,917; 2,270,909; 3,016,975; 2,796,429; 4,109,759; and 4,109,760.

While all of these devices may be satisfactory for some applications, it would be highly desirable to have a relatively inexpensive apparatus which can be conveniently stored when not in use, and which can be quickly brought into service in emergency situations, such as when the building is on fire. In this regard, when the apparatus is used in multi-storied hospital buildings, such apparatus should facilitate the removal of patients and other persons and property in a fast and efficient manner. Such apparatus should be relatively inexpensive to manufacture, and should be easy to install without modification to the existing structure.

Disclosure of Invention

Therefore, the principal object of the present invention is to provide a new and improved emergency apparatus and a method of using it, in such a manner that the apparatus can be conveniently stored when not in use, and can be brought into service in a quick and easy manner for helping in the evacuation of large buildings during emergencies.

Briefly, the above and further objects of the present invention are realized by providing emergency escape apparatus which is adapted to be used with a staircase of the building. The method of using the apparatus is to maintain it in an upright position adjacent to a railing or the like for the staircase.

The emergency escape apparatus includes a slide device installed at a staircase, and includes a slide member extending at an incline over the stairs when disposed in its use position. In order to use the apparatus, the slide member swings about a hinge device connected at one side edge of the slide member between an upward storage position adjacent to the railing or the like and the incline use position over the stairs. Mounting devices fix the slide member to the stair case, and a latching device maintains the slide member in its upright storage position in a releasable manner.

BRIEF DESCRIPTION OF DRAWINGS

The above-mentioned and other objects and features of this invention and the manner of attaining them will become apparent and the invention itself will be best understood by reference to the following description of an embodiment of the invention taken in conjunction with the accompanying drawings, wherein.

BEST MODE OF CARRYING OUT THE INVENTION

Figures 1, 2, 3, 4, 5:
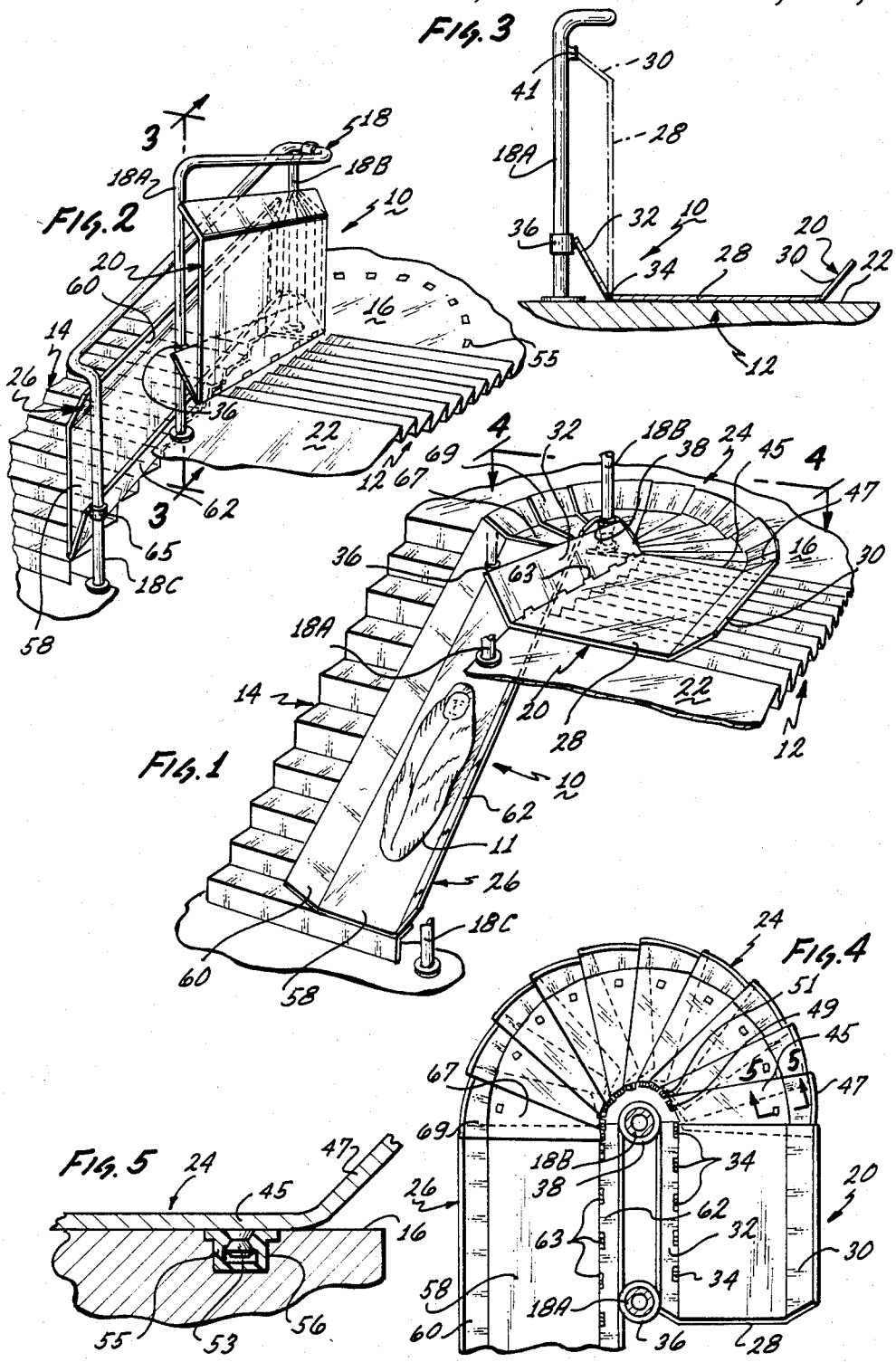
FIG. 1 is a fragmentary pictorial view of the emergency escape apparatus, which is constructed in accordance with the present invention and which is shown disposed in its use position on a building staircase.
FIG. 2 is a reduced-scale pictorial view of the apparatus of FIG. 1, illustrating it in its storage position.
FIG. 3 is an elevational enlarged-scale sectional view of the apparatus of FIG. 2, illustrating it in its use position.
FIG. 4 is a plan view drawn to a reduced scale, taken on line 4—4 of FIG. 1.
FIG. 5 is a detailed sectional view of FIG. 4 taken substantially along line 5—5 thereof.

Referring now to the drawings, and more particularly to FIGS. 1 and 2 thereof, there is shown an emergency escape apparatus 10, which is constructed in accordance with the present invention, and which is used to evacuate persons, such as the person 11, from a building (not shown). The apparatus 10 is primarily intended for use in a multi-storied building, such as a hospital, but it is understood that those skilled in the art will realize that the apparatus of the present invention can be used in many different types and kinds of building structures or the like.

As shown in the drawings, the apparatus 10 enables the person 11 to be slid therealong over an upper staircase 12 along a horizontal intermediate landing 16 and over a lower staircase 14. A railing 18 extends along both the upper and lower staircases and, as shown in FIG. 2, the apparatus 10 is disposed in a generally upright position adjacent to the railing 18 when the apparatus 10 is disposed in its storage position. In such a position, the apparatus 10 is disposed conveniently away from the staircases so as not in interfere with the free flow of traffic therealong.

It will become apparent to those skilled in the art that the apparatus 10 can be conveniently and readily installed in existing buildings, without the need for major modifications to the existing structure.

As shown in FIG. 1, the apparatus 10 generally comprises an upper slide 20 which is disposed over the staircase 12, when the upper slide 20 is disposed in its use position. The upper slide 20 extends between an upper landing 22 and the intermediate landing 16.

As shown in FIG. 1, an intermediate landing slide device 24 is adapted to be disposed horizontally in its use position, over the intermediate landing 61. When the lower slide 26 is disposed in its use position as shown in FIG. 1, a lower slide 26 extends downwardly from the landing slide device 24 on an incline over the lower staircase 13.

Considering now the upper slide 20 in greater detail, the upper slide generally comprises an elongated flat sheet 28, which has an upwardly bent outer side flange 30 and an upwardly extending inner side flange 32 to guide the sliding of the person 11 therealong. A hinge 34 interconnects the inner side flange 32 with the inner side marginal edge of the sheet 28 so that the sheet 28 and the outer side flange 30 can swing thereabout into an upright storage position as shown in FIGS. 2 and 3 of the drawings.

An upper mounting device 36 in the form of a collar is disposed about a post 18A of the railing 18, and a similar lower mounting device 38 in the form of a collar is disposed about a post 18B of the railing 18 to secure the upper and lower portions of the inner side flange 32 thereto. In this manner, the entire upper slide 20 is fixed to the railing 18.

As shown in FIG. 2, in order to releasably attach the sheet 20 and its upper flange 30 to the railing 18 when the upper slide 20 is disposed in its storage position, a permanent magnet 41 (FIG. 3) is secured to the post 18A to attract and hold releasably the metallic slide 20 thereto magnetically. A similar permanent magnet (not shown) is secured to the lower vertical post 18B for attracting the lower end portion of the outer flange 30.

Considering now the intermediate slide device 43, the device generally comprises a series of pie-shaped landing sheets, such as the pie-shaped landing sheet 45, which are disposed in a semi-circular, fan-shaped arrangement, and which have overlapping side marginal edges. Each one of the sheets, such as the sheet 45, is similar to one another, and therefore only the sheet 45 will now be described in greater detail.

As best seen in FIG. 4, the sheet 45 includes an outer, upwardly extending side flange 47 and an inner upwardly extending side flange 49. A hinge 41 interconnects the inner side flange 49 to the sheet 45 so that the sheet 45 and its outer side flange 45 can swing upwardly about the hinge 41 into the storage position, as shown in FIG. 2, in a similar manner as the upper slide 20 swings upwardly into its storage position.

When the sheet 45 moves downwardly into its horizontal use position as shown in FIG. 1, a stud 53 extends from the underside of the sheet 45 to engage a flexible socket 55 disposed in the landing 16. The socket 55 is lined with a resilient material, such as rubber or other elastomeric material. In this manner, the stud 53 can readily snap into firm engagement with the socket 55, and yet the sheet 45 can be pulled upwardly to release it from the landing 16, when returning the slide device to its storage position. As indicated in FIG. 2, similar sockets are disposed in the landing 16 for receiving corresponding studs (not shown) in each one of the other pie-shaped landing sheets, and each one of them fit within openings, such as the opening 56 (FIG. 5), in the landing 16 to be flush therewith.

As shown in FIG. 2, in order to retain the pie-shaped sheets in their upright storage positions, a plurality of magnets (not shown), similar to the magnet 41 of FIG. 3, are disposed on the upright post 18B for magnetically attaching to the pie-shaped sheets to hold them in their upright positions. In order to move the intermediate slide device from its storage position to its use position, someone standing on the upper landing 22 normally pulls on the upper slide 20 and swings it downwardly about the hinges 34 into the use position. In doing so, the bottom end of the sheet 28 and outer flange 30 pull the sheet 45 and its outer flange 37 downwardly therewith to swing about its hinge 51. Similarly, the other pie-shaped sheets slightly overlap so that each pie-shaped sheet pulls on its adjacent sheet, whereby all members of the device are pulled downwardly into the horizontal use position in a "dominoes" effect.

Considering now the lower slide 26 in greater detail, the lower slide 26 includes a rectangular sheet having an upwardly bent outer side flange 60 and an upwardly extending inner slide flange 62, in a manner similar to the construction of the upper slide 20. As shown in FIG. 4, a hinge 63 interconnects the inner side flange 62 with the 58 to enable the sheet 58 and the outer side flange 62 to swing between the inclined use position as shown in FIG. 1 and the upright storage position shown in FIG. 2.

Magnets (not shown) on the posts 18C and 18B of the railing 18 releasably secure the lower slide 26 in its upright storage position. In order to secure the entire lower slide 26 to the lower staircase 14, the upper end of the inner side flange 62 is secured to the collar mounting device 38 (FIG. 4), and the lower end of the inner side flange 62 is connected to a collar mounting device 65.

The upper end of the sheet 58 and the outer side flange 60 fit under the last pie-shaped sheet 67 of the slide device 24 and its outer flange 69, as best seen in FIG. 4, so that when the device 24 is pulled downwardly by the upper slide 20, the device 24, in turn, causes the lower slide 26 to swing outwardly into its use position.

While a particular embodiment of the present invention has been disclosed, it is to be understood that various different modifications are possible and are contemplated within the true spirit and scope of the appended claims. For example, different materials may be employed, such as aluminum, or suitable high-temperature plastic materials. Also, it is contemplated to facilitate the movement of the pie-shaped landing sheets into the use position by providing connecting elements (not shown), such as springs (not shown), for interconnecting the pie-shaped members to facilitate the "domino" effect. There is not intention, therefore, of limitations to the exact abstract or disclosure herein presented.

I claim:

1. Emergency escape apparatus adapted to be used with a staircase adjacent to an upright railing or the like, comprising:

slide means adapted to be installed at the staircase, said slide means including an elongated slide member for extending at an incline over the staircase when disposed in a use position;

hinge means connected at one side edge of said slide member to enable it to swing upwardly about said hinge means into an upright storage position adjacent to the railing or the like;

mounting means for fixing said slide means to said staircase;

latching means for maintaining said slide member in its upright storage position in a releasable manner, wherein the first-mentioned staircase is disposed in a vertically displaced position adjacent to a second staircase in a side-by-side manner to provide a continuous inclined path of travel along the first-mentioned staircase over a horizontal landing and from there along the second staircase; and further includes second slide means for installation at the second staircase, landing slide means for installation at the landing to provide a continuous substantially uninterrupted path of travel between the first-mentioned and the second slide means when disposed in their use positions, wherein said landing slide means includes a series of landing slide members for extending over the landing surface flat thereagainst, said landing slide members being disposed in overlapping positions, wherein said landing slide means includes hinge means connecting the side edges of said landing slide members to enable said landing slide members to swing upwardly about said hinge means into an upright storage position adjacent to the railing or the like; said hinge means is connected to the landing; and latching means maintains each one of said landing slide members in their upright storage positions in a releasable manner; and a plurality of socket means mounted fixedly in the landing, and a plurality of corresponding studs mounted individually on each one of the landing slide members to engage the respective socket means when the landing slide members move into their horizontal use positions.

2. Emergency escape apparatus adapted to be used with a staircase adjacent to an upright railing or the like, the staircase is disposed in a vertically displaced position adjacent to a second staircase in a side-by-side manner to provide a continuous inclined path of travel along the first-mentioned staircase over a horizontal landing and from there along the second staircase, comprising first and second slide means for being installed at the respective first and second staircases, each one of said slide means including an elongated slide member for extending at an incline over the staircase when disposed in a use position, hinge means connected at one side edge of said slide member to enable it to swing upwardly about said hinge means into an upright storage position adjacent to the railing or the like; mounting means for fixing said slide means to said staircase, latching means for maintaining said slide member in its upright storage position in a releasable manner;

landing slide means for installation at the landing to provide a continuous substantially uninterrupted path of travel between said first and second slide means when disposed in their use positions, said landing slide means includes hinge means connecting the side edges of said landing slide members to enable said landing slide members to swing upwardly about said hinge means into an upward storage position adjacent to the railing or the like, said hinge means being connected to the landing, and latching means for maintaining said landing slide means in its upright storage positions in a releasable manner; and said first slide means having a lower portion overlapping one end portion of said landing slide means, and said landing slide means having an opposite end portion overlapping an upper portion of said second slide means to enable said second slide means and said landing slide means to be pulled down into their use positions when said first slide means is pulled down into its use position, whereby when said first slide means is moved into its use position by moving an upper portion thereof, the overlapping lower end thereof pulls down on the landing slide means to cause it to move into its use position, and in turn, to pull down on the overlapping upper portion of said second slide means for causing it to move into its use position.

3. Emergency escape apparatus according to claim 2, wherein said landing slide means includes a series of landing slide members for extending over the landing surface flat thereagainst, said landing slide members being disposed in overlapping positions to enable them to be pulled sequentially once an upper one thereof is pulled down by said first slide means according to a dominoes effect.

4. Emergency escape apparatus according to claim 3, wherein each one of said latch members includes a permanent magnet.

5. Emergency escape apparatus according to claim 3, wherein each one of said slide members includes an upstanding outer side flange to help define the path of travel.

6. Emergency escape apparatus according to claim 5, wherein each one of said slide members includes a fixedly connected inner side flange adapted to be connected fixedly to the railing or the like for helping define the path of travel.

7. A method of using an emergency escape apparatus adapted to be used with a pair of upper and lower side-by-side staircases adjacent to an upright railing or the like extending therealong, a landing being interposed therebetween, comprising:

providing upper, lower and landing slide means having respective hingedly connected elongated slide members;

mounting said slide members adjacent to the railing in an overlapping manner;

swinging the slide members upwardly into an upright storage position adjacent to the railing or the like;

latching the slide member in its upright position in a releasable manner;

moving the upper portion of said upper slide means to cause its slide member to swing down into an inclined use position over the upper staircase to, in turn, cause the lower overlapping portion thereof to pull down on the landing slide means to cause it to move downwardly into its use position overlying the landing, and in turn, to pull down on the overlapping upper portion of said lower slide means for causing it to move into its use position overlying said lower staircase.

* * * * *

UNITED STATES PATENT AND TRADEMARK OFFICE

CERTIFICATE OF CORRECTION

PATENT NO. : 4,498,557

DATED : February 12, 1985

INVENTOR(S) : June B. Horne

It is certified that error appears in the above-identified patent and that said Letters Patent are hereby corrected as shown below:

Column 1, line 21 after "3,016,975;", delete "2,796,429" and substitute --3,796,429-- therefor.

Signed and Sealed this

*Sixteenth* Day of *July 1985*

[SEAL]

*Attest:*

DONALD J. QUIGG

*Attesting Officer* *Acting Commissioner of Patents and Trademarks*